United States Patent [19]

Pupovic

[11] Patent Number: 4,847,929

[45] Date of Patent: Jul. 18, 1989

[54] BED WITH ADJUSTABLE POSITIONS

[76] Inventor: Milenko Pupovic, Filipa Filipovica 40, 11400 Mladenovac, Yugoslavia

[21] Appl. No.: 128,801

[22] Filed: Dec. 4, 1987

[51] Int. Cl.[4] ..... A47C 19/00; A61G 7/00

[52] U.S. Cl. ..... 5/62; 5/90

[58] Field of Search ..... 5/60, 62, 63, 68, 69, 5/90, 66, 67; 378/209

[56] References Cited

U.S. PATENT DOCUMENTS

| | | | |
|---|---|---|---|
| 2,217,782 | 10/1940 | Bell | 5/60 |
| 2,407,892 | 9/1946 | Mehr | 5/90 |
| 2,678,452 | 5/1954 | Beem et al. | 5/90 |
| 2,687,536 | 8/1954 | Miller | 5/69 |
| 2,741,092 | 4/1956 | Marshall | 5/69 |
| 2,840,429 | 6/1958 | McDonald | 378/209 |
| 3,201,806 | 8/1965 | Hutt | 5/60 |
| 3,281,141 | 12/1966 | Smiley et al. | 5/66 |
| 3,397,411 | 8/1968 | Rossi | 5/66 |
| 3,593,350 | 7/1971 | Knight | 5/68 |
| 3,631,242 | 12/1971 | Williams | 378/209 |
| 3,635,461 | 1/1972 | Bellucci et al. | 5/66 X |
| 3,724,004 | 4/1973 | Behrens | 378/209 |
| 3,806,109 | 4/1974 | Weber et al. | 378/209 |
| 3,845,947 | 11/1974 | Lee | 378/209 |
| 3,868,103 | 2/1975 | Pageot | 378/209 |
| 4,139,917 | 2/1979 | Fenwick | 5/60 |
| 4,148,472 | 4/1979 | Rais et al. | 378/209 |
| 4,227,269 | 10/1980 | Johnston | 5/68 |
| 4,409,695 | 10/1983 | Johnston et al. | 5/68 |
| 4,425,673 | 1/1984 | Werner | 5/64 |
| 4,439,879 | 4/1984 | Werner | 5/60 |
| 4,501,414 | 2/1985 | Mason et al. | 378/209 |
| 4,639,954 | 2/1987 | Speed | 5/69 |
| 4,669,136 | 6/1987 | Waters | 5/69 |
| 4,685,159 | 8/1987 | Oetiker | 5/60 |
| 4,722,328 | 2/1988 | Scott et al. | 5/66 X |

FOREIGN PATENT DOCUMENTS

| | | | |
|---|---|---|---|
| 464958 | 3/1952 | Italy | 378/209 |

*Primary Examiner*—Alexander Grosz
*Assistant Examiner*—Eric K. Nicholson
*Attorney, Agent, or Firm*—Shlesinger & Myers

[57] ABSTRACT

The invention concerns a bed with adjustable position, which permits tilting in all positions, which can be lowered and lifted, bent in the knee and back parts, which can be swinged and moved stepwise, in which the patient can be X-rayed, etc. The bed has a support 1 of the bed, on which is fixed a vertical support 2, which carries a horizontal support 6. In the support 2 is provided a Cardan joint 4, which permits the tilting of the bed. A system of hydraulic cylinders 9, 15, 17 and 21 permits the tilting and the moving of the reclined part of the bed, and the joints 8,14 permit the bending of the reclining part of the bed.

18 Claims, 13 Drawing Sheets connected with the support 2, and by the upper side with the support 6. The hydraulic cylinder 21 is by one side connected with the horizontal support 6 and by the other side with the slide 12. The support 22 of the scoop 35 is connected with the upper part of support 2 and support 6. The mechanical set 23 with hydraulic equipment or pneumatic equipment, an electric motor with flexible shafts, is fixed on the support 1 (if central feeding with fluids under pressure is involved, the mechanical sets are not built-in). The actuating board 24 is placed on the support 7. When the structure is realized without hydraulic, pneumatic or electric mechanical mechanisms, the board is not necesssary, i.e. it is not necessary if the movements are realized manually by various mechanisms. The protective barrier 25 below the feet and above the head is detachably and firmly connected with the supports 13 and 7. The lateral protective barrier 26 is connected with supports 13, 11 and 7 by a detachable connected. It is easily removed when necessary. The belt support 27 is fixed on the supports 13, 11 and 7, for special purposes. The belt 28 is connected with the support 27. The mattress 29 is of two parts (it can also have several parts), with a support placed between supports 7, 11 and 13 for preventing it from sinking, and it is convenient that at the juncture above the scoop it be protected by a waterproof cloth. The support 30 of the X-ray film cassette is placed on the lower part of the support of the mattress 29 by detachable connected 31. The hydraulic cylinder 9 is connected with supports 6 and 10, and the hydraulic cylinder 15 with supports 16 and 12, the hydraulic cylinder 17 with supports 1 and 19, the hydraulic cylinder 20 with supports 2 and 6, and the hydraulic cylinder 21 with supports 6 and 12. The vertical support 32 of the auxiliary table 36, which is moved vertically, is fixed by a screw. The box 33 for bedding is connected with the support 7. The box 34 is for small objects. The scoop 35 is placed on the support 22. The auxiliary table 36 is moved and turned in the slide 38 and is fixed by a screw in the slide 38. The pins 39 serve for fixing the horizontal support 6 in the vertical support 2. Four handles 40 are straightened into a horizontal position in the joint 41, in the case when the bed is converted into a stretcher and are connected with the support 7. The four-angled supports 42 are connected with the horizontal support 6.

In the bed according to the invention, hydraulics (or pneumatics) replace spiral spindles, mechanical or manual, with right or with right or left threads.

It is possible to realize variant solutions of the bed: without lower leg bending, without the joint 8, or without possibility of tilting along the longer or shorter side of the bed, only with the scoop 35, etc.

Also, the structure of the bed is realized such that each hydrolic cylinder can function individually, automatically, and programatically together, etc.

The bed is used in the following way. The bed is turned on the Cardan joint 4 by the hydraulic cylinder 17 around the axis of the shorter side of the bed for a certain angle, and by the hydraulic cylinder 20 it is turned about the axis of the longer side of the bed. By the handle and through the screw-axle of the Cardan joint 4, the lateral clearance of the joint is adjusted. The movement of the hydrolic cylinders is individual and in cycle.

The hydraulic cylinder 3, placed in the vertical square telescopic support 2, lifts the bed vertically, by individual work or work in cycle. The back part of the bed turns on the joint 8 with the hydraulic cylinder 9, individually or in cycle. The upper leg part 11 of the bed, the lower leg part 13, along with the lower part of the mattrass 29, by the action of the hydraulic cylinder 21 and the slides 12, which slide on the horizontal support 6, move the back part away, thus forming an aperture sufficient for the patient to perform physiological needs in the scoop 35 placed on the support 22. The support 22 of the scoop can be of plastic material or of sheet metal, and inclined such that, in the case of washing, dirty water runs into the container provided for this. The upper leg part 11 of the bed and the lower leg part 13 bend at the joint 14 by the action of the hydraulic cylinder 15. The task of the mechanical set 23 is to effect the movement of the hydraulic (or pneumatic) cylinders. It is more convenient, and also cheaper, if a central mechanical set is provided.

The function of the actuating board is to actuate (by handle, push button, digitally—in program) individually or individually in cycle with rocking quicker or slower, or individually in cycle in a program conduit.

The protective barrier 26 is easily mounted and dismantled and serves for preventing the patient from falling.

The support 27 of belt 28 (provided if desired) serve for special conditions when the patient has to be tied, and also serves for binding the patient when extension has to be performed, i.e. in the case of herniated disc plastering, and the like.

The belt 28 also serves for binding the patient.

The mattress 29, in two or theree parts, are standard ones, but different in function depending upon the purpose (harder or softer).

The support 30 of the X-ray film cassette serves for placing the cassette for X-raying the patient, to avoid transferring the patient from his bed.

The role of the spherical joint 31 is to turn in all axes in view of the complex movement of hydraulic cylinders 17 and 20. The auxiliary table 36 is used for meals, reading, and is regulated in the joint 38 and 37 by screws, in height, width and angle, and is easily removed.

The box 33 is for the bedding, and the box 34 for small objects.

When military, out-patient, and similar beds are produced, they have disconnected linkings with pins 39, the handles 40 are straightened in the joint 41, and they are converted into stretchers in war conditions. The stretchers rest on four supports 42.

I claim:

1. A multiple position and use bed, comprising:

(a) a ground support frame having a vertically disposed first support comprising a universal joint;

(b) first and second vertically disposed motion means operably connected to said ground supported frame, each of said motion means has a vertically movable upper portion;

(c) a support frame operably connected to said universal joint and to said first motion means upper portion so that movement of said first motion means upper portion causes said support frame to pivot about said universal joint;

(d) a mattress frame carried by said support frame and operably connected to said second motion means upper portion, said mattress frame comprises at least first and second portions and said second portion is pivotal with said first motion means

BED WITH ADJUSTABLE POSITIONS

TECHNICAL FIELD TO WHICH THE INVENTION BELONGS

The invention belongs to the domain of current life needs, and more particularly it concerns a bed intended for persons either ill or on rehabilitation.

1. Technical Problem

The technical problem is how to solve structurally a bed permitting tilting to all positions, lifting and lowering, bending in the knee or back part, in which the patient can be X-rayed, and the like.

2. Prior Art

So far there have been produced a large number of beds intended for persons either ill or in rehabilitation. Some such beds are also produced by the domestic working organisation Kovinsko Podjetje—Ajdovscina. However, none of the beds produced till now is universal, i.e. does not possess all the possibilities requested in some cases.

STATEMENT OF THE BEST MODE OF USING THE CLAIMED INVENTION IN THE ECONOMY

All the parts of the bed structure are made of general purpose steel, which, if desired, is chromium plated or nickel plated. The hydraulic cylinders 3, 9, 15, 17 and 21 are obtained as finished products on the market, and also the other parts are obtained as finished products, such as the self-adjusting wheels.

DESCRIPTION OF THE SOLUTION OF THE TECHNICAL PROBLEM WITH EXAMPLES OF IMPLEMENTATION WITH LIST AND BRIEF DESCRIPTION OF THE DRAWINGS

The purpose of the invention is to provide a bed with universal possibilities. The bed comprises the basic parts and assemblies, namely a support with self-adjusting wheels, with or without brake, and which carries a horizontal support on which two other supports are connected with joints. A system of hydraulic cylinders, connected with the support with wheels and the supports with joints, permits the moving and the inclining of the bed in both axes, swinging, bending of the bed line, and the like. The invention will be shown more clearly on the enclosed drawings, in which the figures represent:

Figure 3:
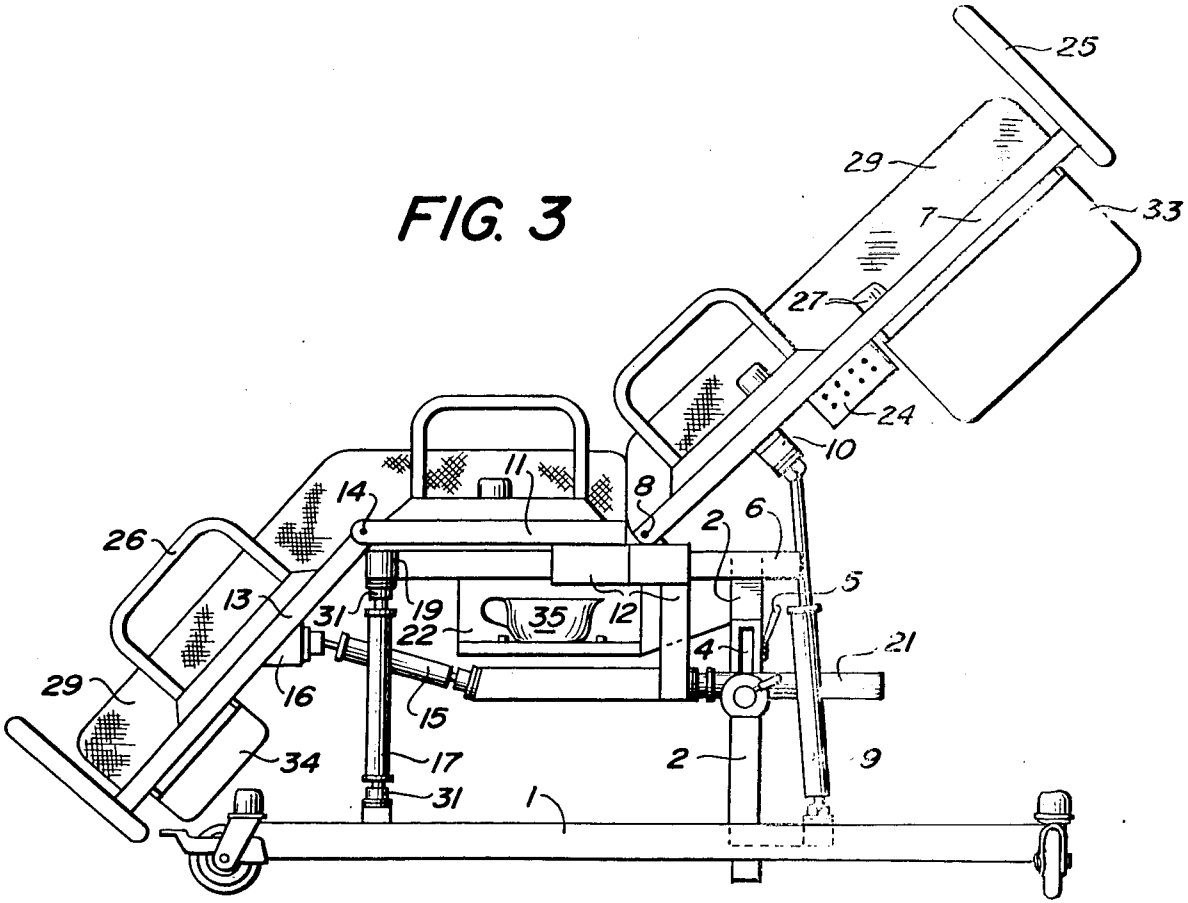

FIG. 3 shows the bended lower leg part 13 of the bed, with the hydraulic cylinder 15 and the joint 14.

Figure 1:
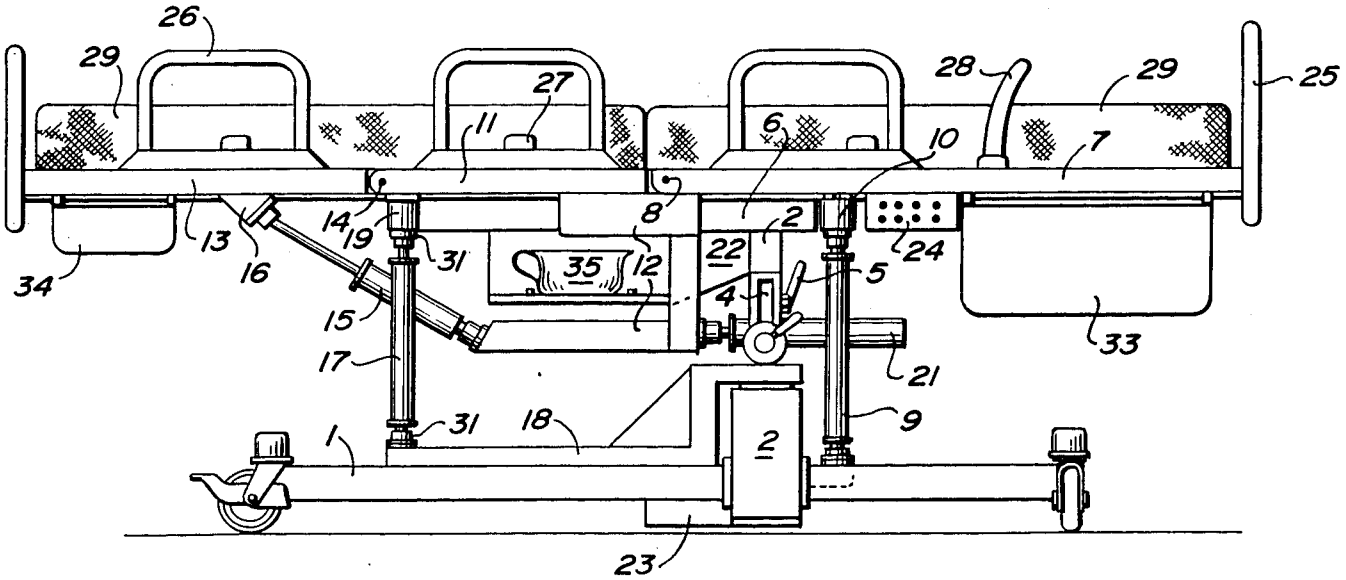
FIG. 1 is a side view of the bed in normal position.
Figure 2:
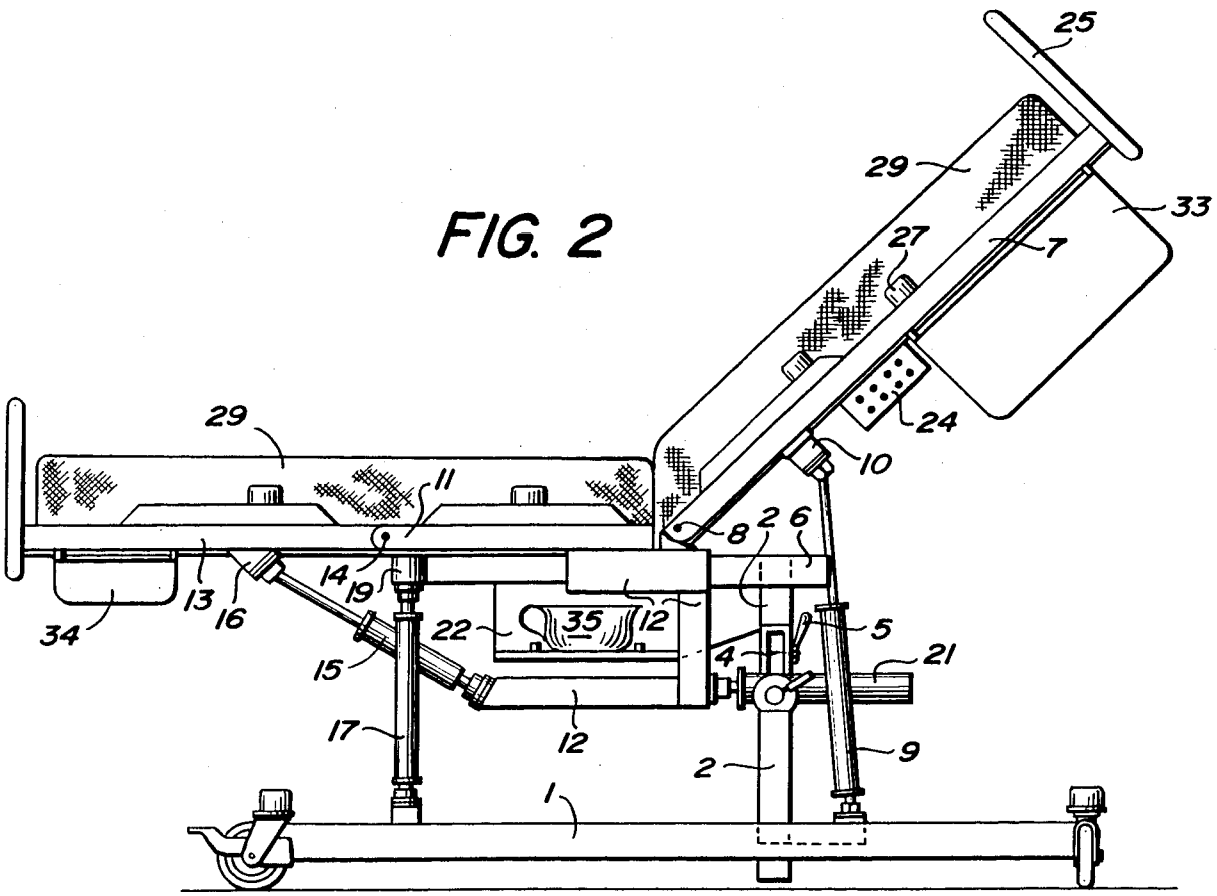
FIG. 2 shows the raised back part 7 of the bed, with the hydraulic cylinder 9.
Figure 4:
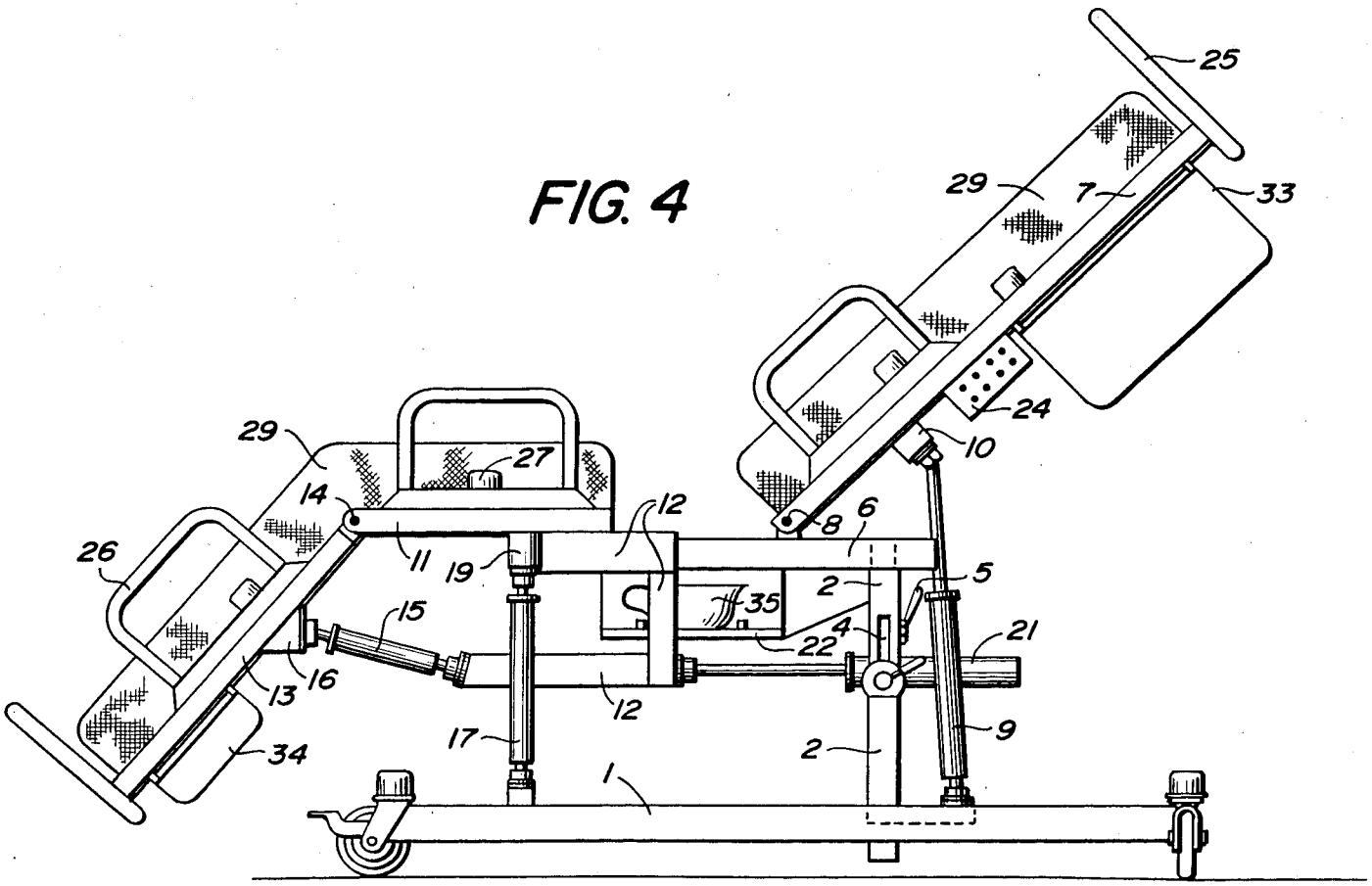

FIG. 4 shows the displaced parts 11 and 13 of the bed with the mattress under the action of the hydraulic cylinder 21 on the slides 12 which move on the horizontal support 6, thus forming an aperture for the excrement scoop 35. This is the most suitable position for performing the physiological needs of the patient, and it is as in FIG. 1 and as in FIG. 2, a function of the immobility of the patient.

Figure 5:
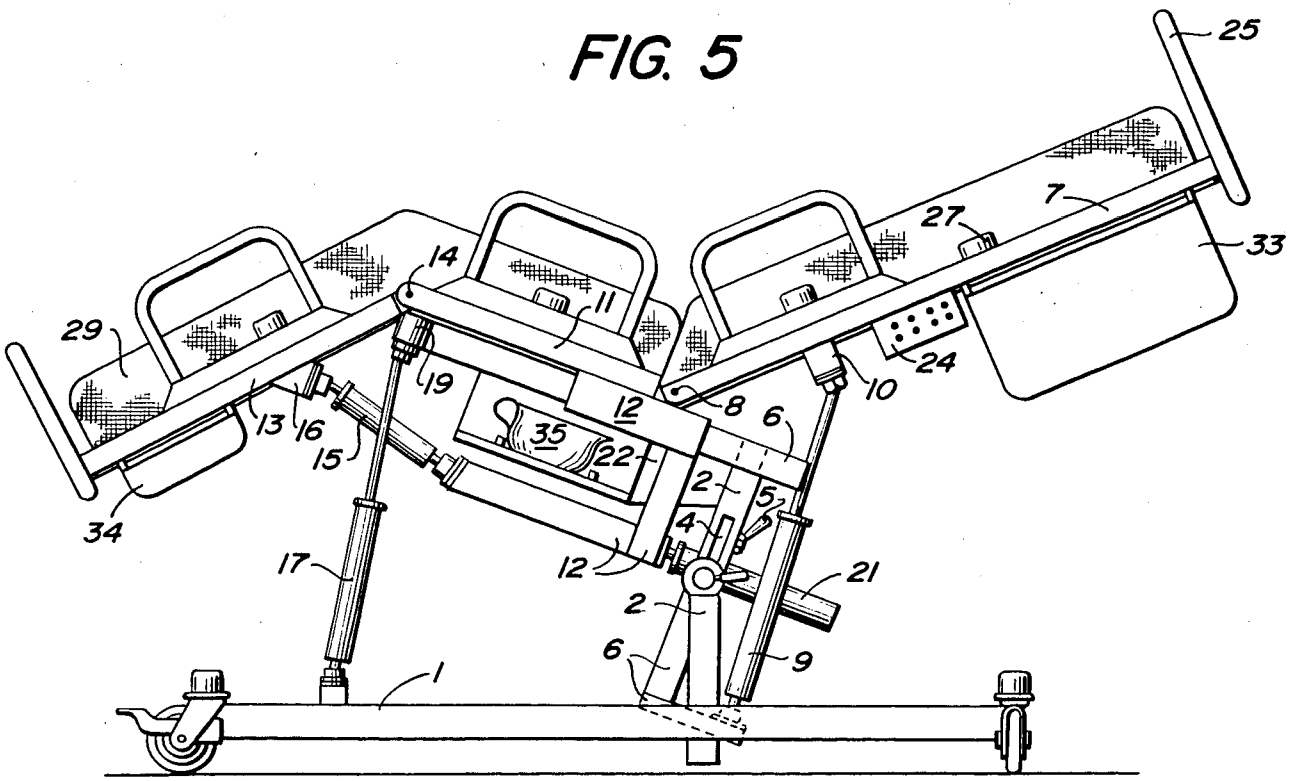

FIG. 5 shows the tilting of the bed for a certain angle by the hydraulic cylinder 17 and the joint 4. This figure shows the very comfortable lying and resting position of the patient. Furthermore, if the working of the hydraulic cylinder is in cycle, rocking of the bed takes place.

Figure 6:
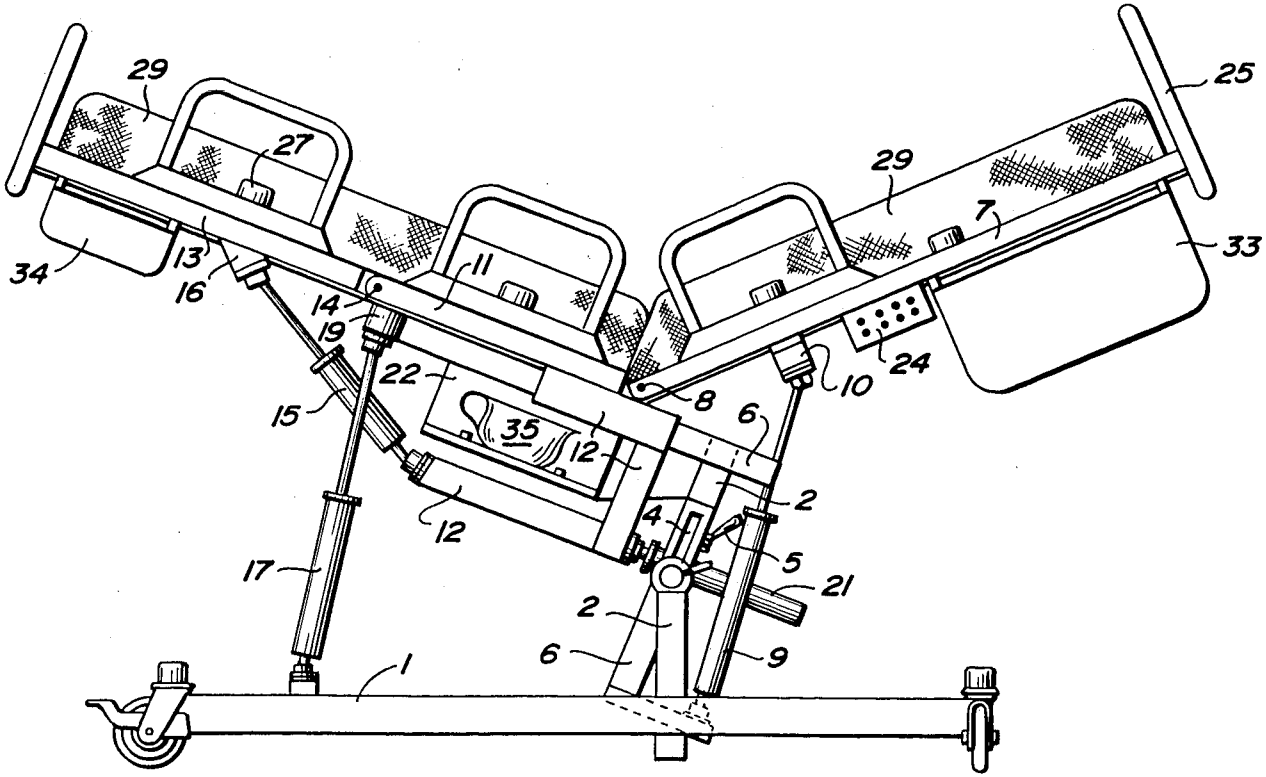

FIG. 6 shown in same as FIG. 5, but without the bent lower leg part 13.

Figure 7:
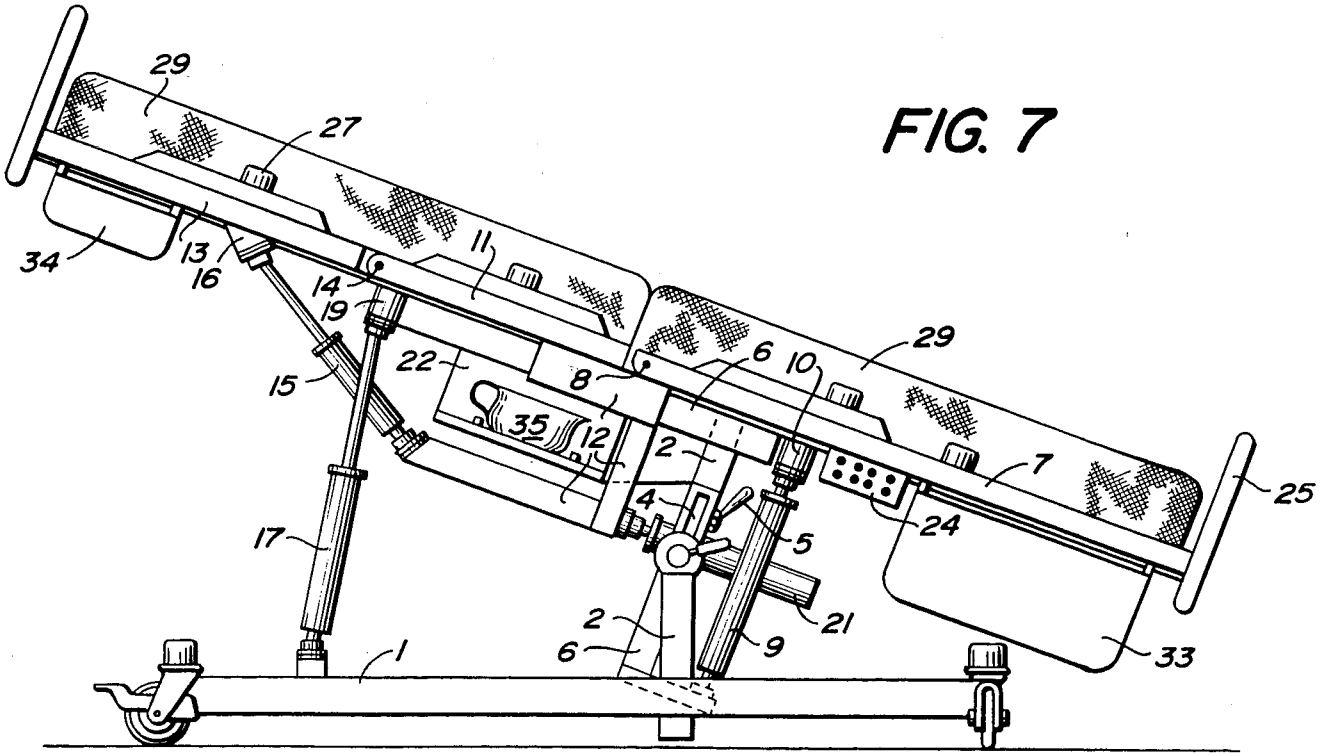

FIG. 7 shows the same as FIG. 6, but without the bent back part 7. This is the position for lung respiration and the like, for rehabilitation, and rest in the case of swinging and rocking.

Figure 8:
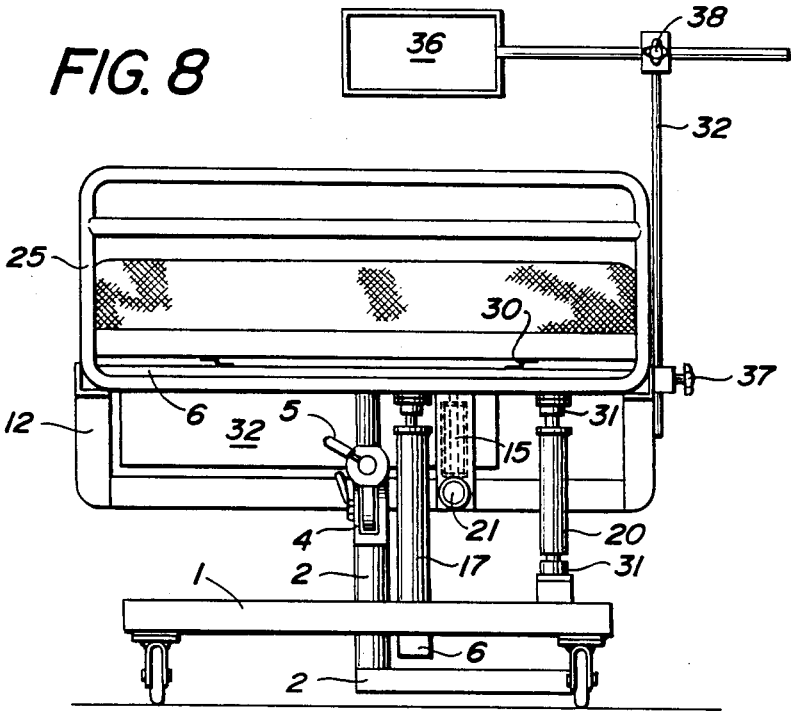

FIG. 8 is a view from the head (back part) when the bed is in normal position and in connection with the auxiliary table 36.

Figure 9:
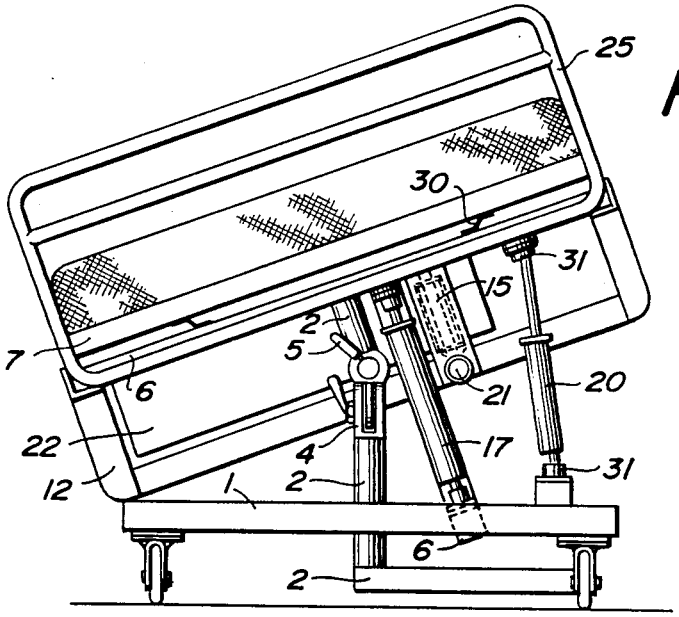

FIG. 9 shows the same as FIG. 8, but in inclination by means of the hydraulic cylinder 20 which is to the lateral side of the Cardan or universal joint 4 and without the auxiliary table.

Figure 10:
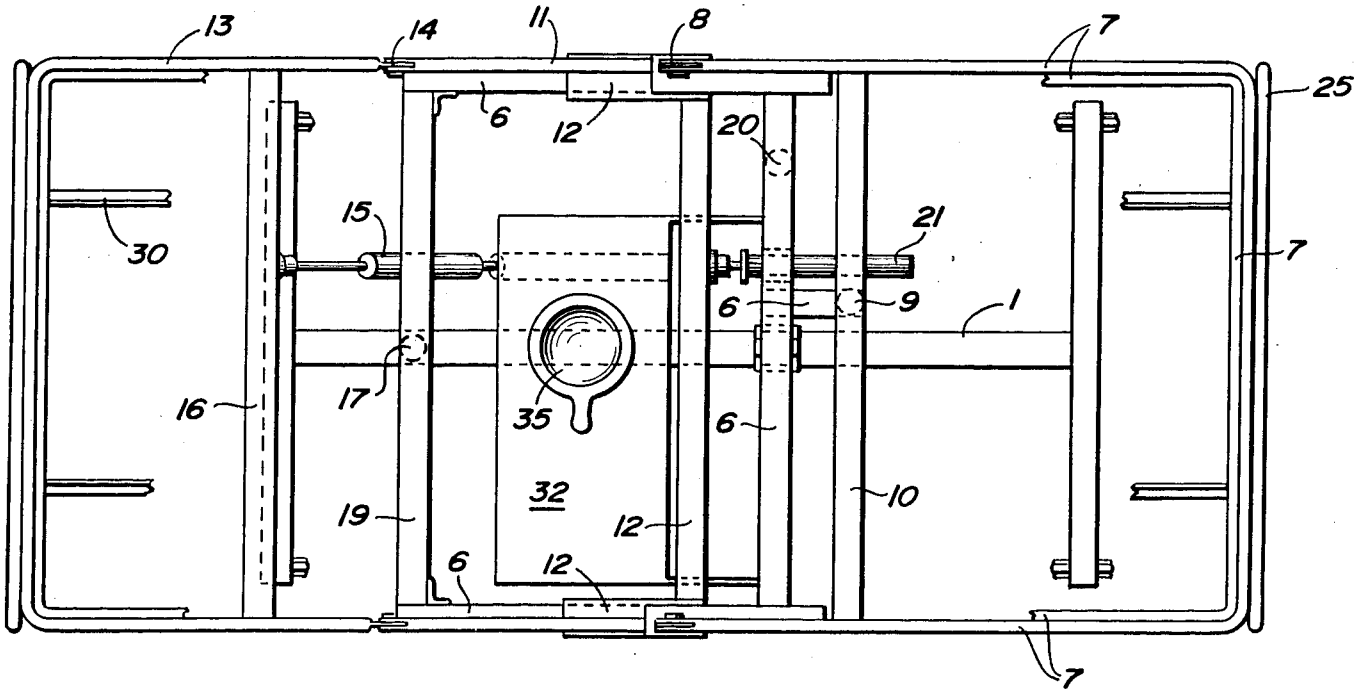

FIG. 10 is a view from above, with the supporting part of the mattress and mattress 29 removed.

Figure 11:
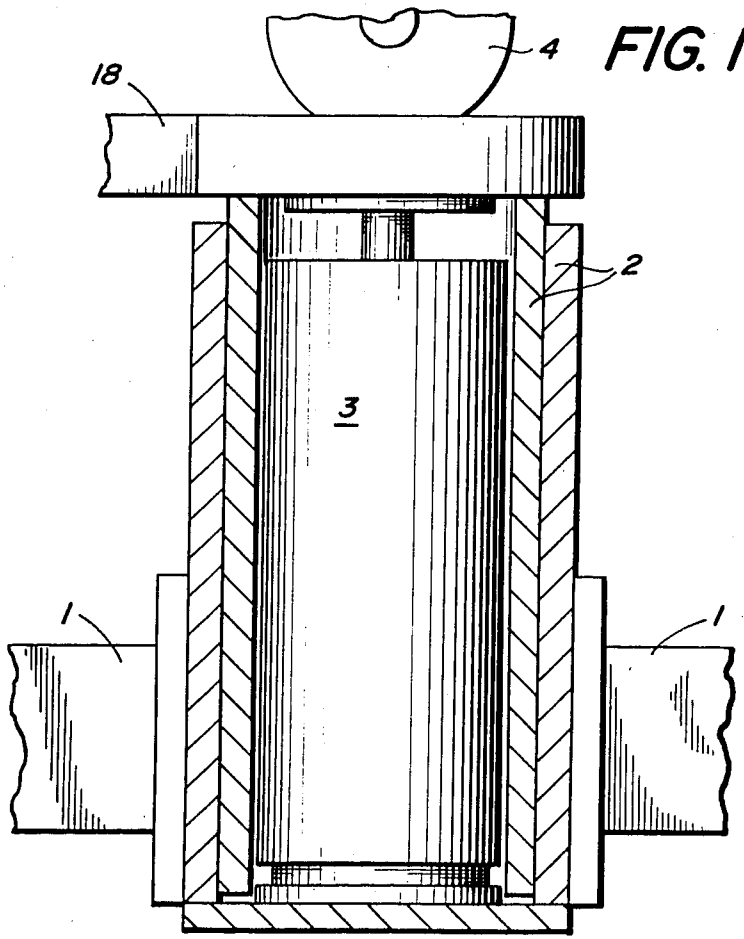

FIG. 11 shows the structure of the vertical column 2 in vertical section, with a hydraulic cylinder 3 built-in for the vertical lifting of the table. The horizontal support 1 is cut and is connected with the lateral square telescopic support 2, which is square in order to prevent the turning of the bed about the vertical axis (in circle).

Figure 12A:
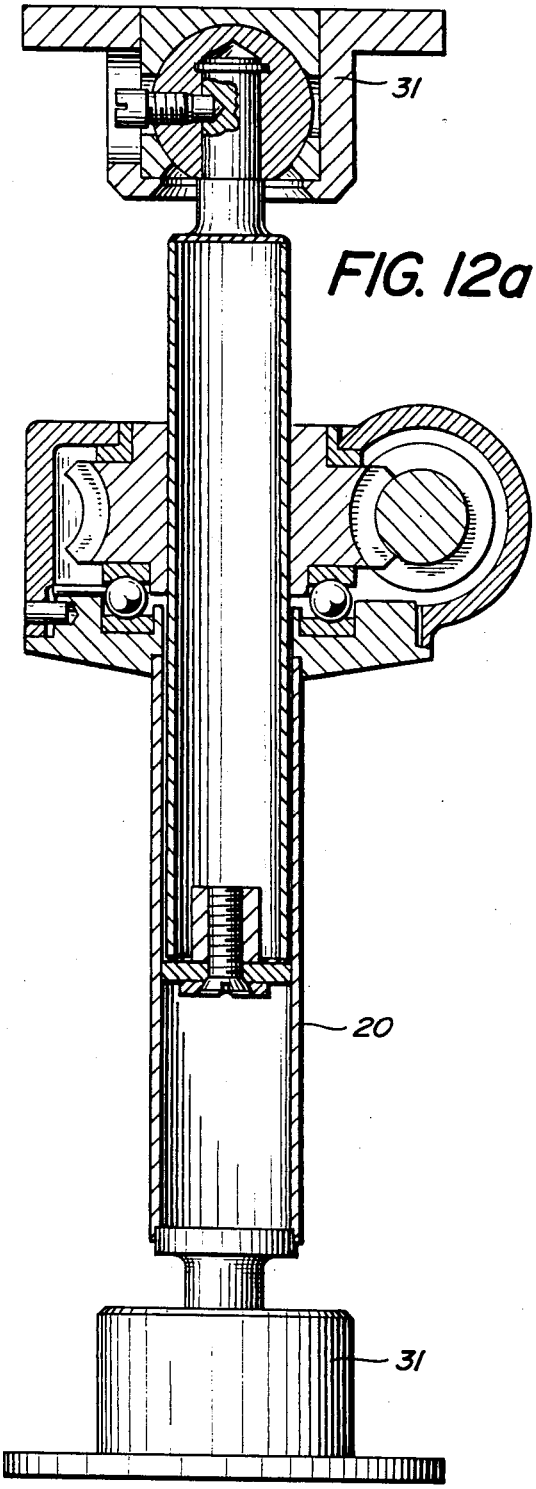

FIG. 12*a* shows an electromechanical mechanism through a thread and worm transmission.

Figure 12B:
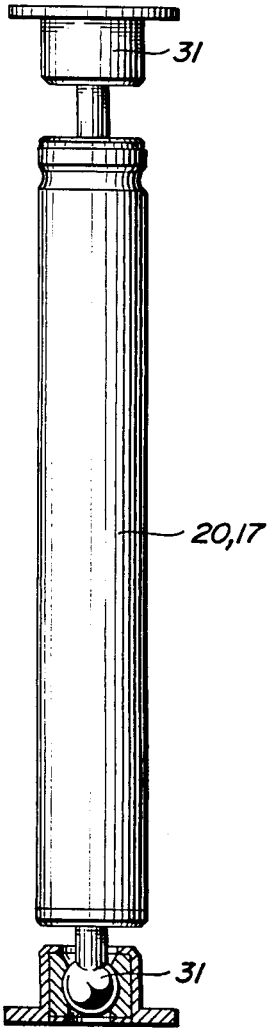

FIG. 12*b* shows a hydraulic or pneumatic actuator for the mentioned functions of the bed. Mechanisms with eccentric movement or manual ones are also realized. Furthermore, on FIG. 12 is shown the structure of the spherical joint 31, which permits the turning of the bed about the longitudinal and the transversal axes (about x and y axes).

Figure 13:
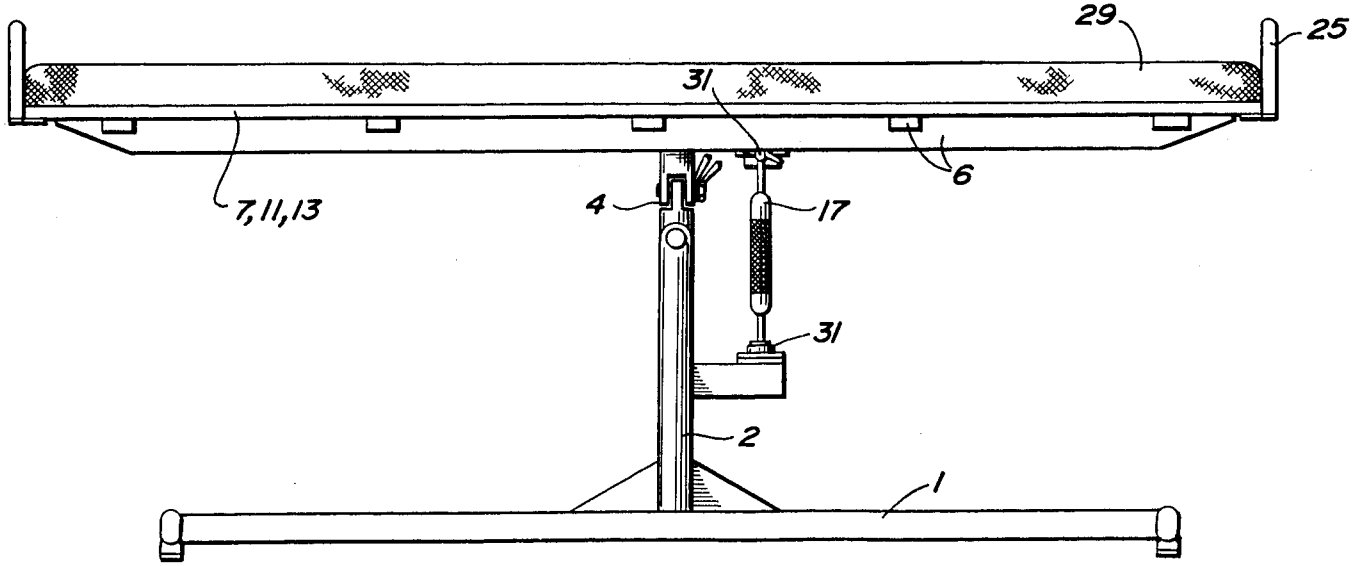

FIG. 13 shows a bed for rehabilitation, rest, an outpatient general purpose bed, and the like, in a side view and with a mechanical mechanism for turning the bed, i.e. the hydraulic cylinder 17 has been replaced by a left-right thread.

Figure 14:
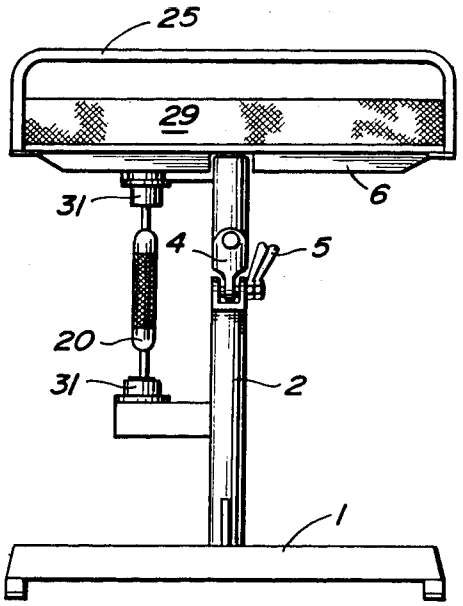

FIG. 14 is a front view of the bed of FIG. 13.

Figure 15:
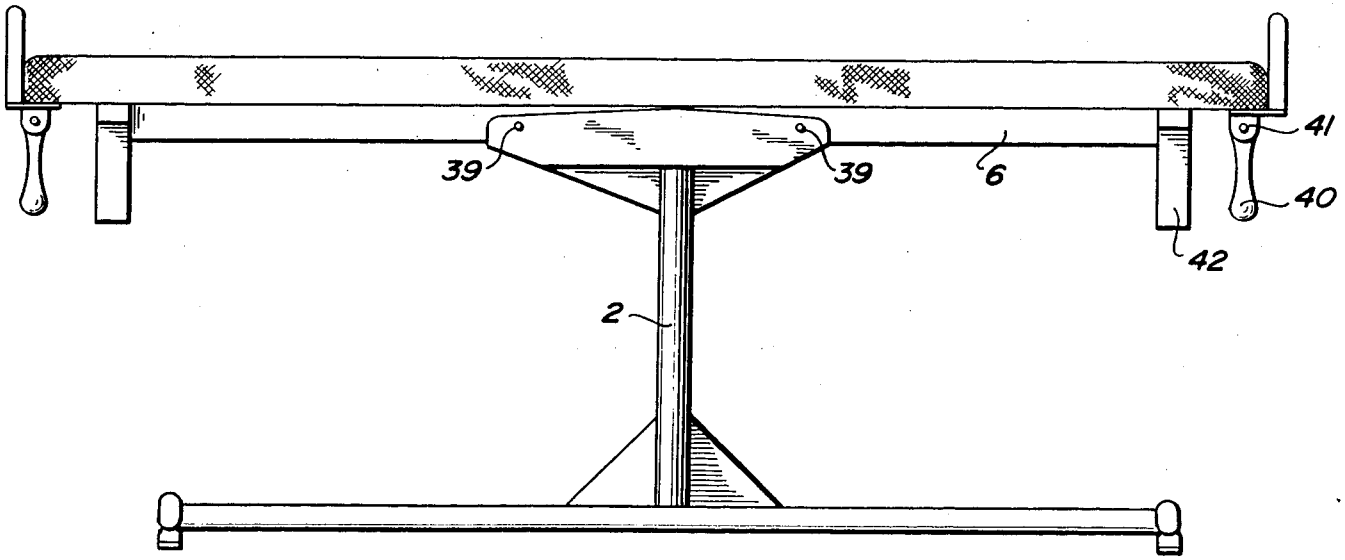

FIG. 15 is a side view of a bed adapted as a stretcher.

The floor support 1 of the bed, which is made with self-adjusting wheels and brake, or without wheels and brake comprises a vertical support 2 fixed on it. The support 2 can have a hydraulic cylinder 21 (FIG. 1 and FIG. 11) built in a square telescope. On the vertical support 2 is fixed a Cardan or universal joint 4, and the clearance of the joint 4 is adjusted by a handle 5. On the top of the vertical support 2 is fixed a horizontal support 6 of the bed. On the horizontal support 6 are fixed two supports 7 and 11 connected by joints 8, through which is connected the back part of the bed with one side and with the other, through support 10 (which is rigidly connected with the back support 7), it rests on the hydraulic cylinder 9. The hydraulic cylinder 9 is with its other side coupled with the support 6. The support 11 is fixed on two slides 12. The support 13 is with one side connected through two joints 14 and with the other side on the support 16, and then on the hydraulic cylinder. The joints 14 (two) are located on one and on the other side of the bed on the supports 11 and 13. The hydraulic cylinder 15 is with one side connected with the support 6, and with the other side with the slide 12. The hydraulic cylinder 17 is by its lower side connected with the support 18 (FIG. 1) in the case when the structure is realized with the hydraulic cylinder 3, as best shown in FIG. 11. If the structure is realized without the hydraulic cylinder 3, the hydraulic cylinder 17 is by its lower side rigidly connected with the support 1, and by the upper side with the support 19. The support 19 is detachably connected and firmly with the support 6 (FIG. 10). The hydraulic cylinder 20 is by the lower side upper portion and said first portion is slidably associated with said support frame;

(e) third motion means operably connected to said support frame and including a movable end portion operably connected with said mattress frame first portion for displacing said first portion toward and away from said second portion; and, (f) first and second mattress portions carried by said first and second mattress frame portions and movable therewith.

2. The bed of claim 1, wherein:

(a) said first support is disposed intermediate said first and second motion means.

3. The bed of claim 2, wherein:

(a) each of said motion means comprises a cylinder and piston assembly, and the cylinder of each of said cylinder and piston assemblies is operably connected to the associated frame.

4. The bed of claim 3, wherein:

(a) said third motion means is angularly disposed relative to said first and second motion means.

5. The bed of claim 1, wherein:

(a) said mattress frame first portion includes a leg portion and a thigh portion pivotally connected thereto, said thigh portion disposed adjacent said second portion and said third motion means is operably connected to said thigh portion.

6. The bed of claim 5, wherein:

(a) said second motion means upper portion is operably connected to said thigh portion.

7. The bed of claim 1, wherein:

(a) said first and second motion means are mutually laterally displaced relative to said first support.

8. The bed of claim 5, wherein:

(a) said support frame includes an extension extending below and along said mattress frame second portion; and, (b) a fourth motion means is operably connected to the terminal end of said extension and to said mattress frame leg portion of causing pivoting thereof.

9. The bed of claim 8, wherein:

(a) said third motion means extends generally transverse to said first and second motion means and said fourth motion means extends angularly relative to said first, second and third motion means.

10. A multiple position bed system, comprising:

(a) a ground supported longitudinally extending frame;

(b) a first vertical support secured centrally to said ground supported frame and extending vertically therefrom, said first support includes a universal joint at the upper end thereof;

(c) first and second cylinder and piston assemblies secured to said frame and extending vertically therefrom, the cylinders thereof are pivotally secured to said frame and the pistons thereof extend upwardly therefrom;

(d) a support frame operably connected to said universal joint and to said firt cylinder and piston assembly piston so that extension and retraction of said first cylinder and piston assembly piston causes pivoting of said support frame about said universal joint;

(e) a mattress frame carried by said support frame comprises first and second sections, said first section is operably connected to said second cylinder and piston assembly piston so that extension and retraction thereof causes pivoting of said first section and said second section is slidably associated with said support frame; and, (f) a third cylinder and piston assembly has the cylinder thereof operably connected to said support frame and the piston thereof operably connected to said second section so that extension and retraction of the piston thereof causes said second section to be displaced toward and away from said first section.

11. The system of claim 10, wherein:

(a) said first and third cylinder and piston assemblies are laterally displaced relative to said first support and said second cylinder and piston assembly.

12. The system of claim 10, wherein:

(a) said first cylinder and piston assembly is disposed intermediate said third cylinder and piston assembly and said vertical support.

13. The system of claim 10, wherein:

(a) said mattress frame second section comprises first and second pivotally connected portions, said second portion disposed adjacent said first section; and, (b) a fourth cylinder and piston assembly, the cylinder thereof is operably connected to said support frame and the piston thereof is operably connected to said first portion so that extension and retraction thereof causes pivoting of said first portion.

14. The system of claim 13, wherein:

(a) said third and fourth cylinder and piston assemblies are longitudinally aligned and mutually laterally spaced relative to said first support.

15. The system of claim 13, wherein:

(a) said support frame includes a frame extension extending below and along said mattress frame second portion; and, (b) said fourth cylinder and piston assembly has the cylinder thereof secured to the terminal end of said extension.

16. The system of claim 13, wherein, (a) said third cylinder and piston assembly extends generally transverse to said first and second cylinder and piston assemblies and said fourth cylinder and piston assembly is angularly disposed relative to said second cylinder and piston assembly.

17. The system of claim 16, wherein:

(a) said vertical support is disposed intermediate said first and second cylinder and piston assemblies and said fourth cylinder and piston assembly is proximate said second cylinder and piston assembly.

18. The system of claim 15, wherein:

(a) a support plate is secured to and disposed below said support frame proximate said mattress frame first section for receiving a first receptacle so that displacement of said second section away from said first section permits said receptacle to be accessed.

* * * * *